US008524431B2

(12) United States Patent
Nagasaka et al.

(10) Patent No.: US 8,524,431 B2
(45) Date of Patent: Sep. 3, 2013

(54) ELECTROPHOTOGRAPHIC PHOTOSENSITIVE MEMBER, PROCESS CARTRIDGE AND ELECTROPHOTOGRAPHIC APPARATUS

(75) Inventors: Hideaki Nagasaka, Suntou-gun (JP); Kunihiko Sekido, Numazu (JP); Shinji Takagi, Yokohama (JP); Akihiro Maruyama, Susono (JP); Michiyo Sekiya, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 227 days.

(21) Appl. No.: 12/911,810

(22) Filed: Oct. 26, 2010

(65) Prior Publication Data

US 2011/0104599 A1 May 5, 2011

(30) Foreign Application Priority Data

Nov. 2, 2009 (JP) ..... 2009-252120

(51) Int. Cl.
*G03G 5/14* (2006.01)

(52) U.S. Cl.
USPC ..... 430/65; 430/60; 430/64

(58) Field of Classification Search
USPC ..... 430/60, 64, 65; 399/159
See application file for complete search history.

(56) References Cited

U.S. PATENT DOCUMENTS

| | | | | |
|---|---|---|---|---|
| 4,994,339 | A * | 2/1991 | Kinoshita et al. | 430/78 |
| 5,658,702 | A | 8/1997 | Nukada | |
| 5,972,550 | A | 10/1999 | Tamura et al. | |
| 6,750,288 | B2 | 6/2004 | Pradel | |
| 6,777,096 | B2 * | 8/2004 | Shiba et al. | 428/463 |
| 6,831,131 | B2 | 12/2004 | Bouilloux et al. | |
| 2003/0040579 | A1 | 2/2003 | Pradel | |
| 2003/0130429 | A1 | 7/2003 | Bouilloux et al. | |
| 2005/0196196 | A1 * | 9/2005 | Ota et al. | 399/159 |
| 2005/0282076 | A1 | 12/2005 | Tanaka et al. | |
| 2006/0292469 | A1 | 12/2006 | Nagasaka et al. | |

FOREIGN PATENT DOCUMENTS

| | | | |
|---|---|---|---|
| EP | 0378153 | A2 | 7/1990 |
| JP | 01-289965 | A | 11/1989 |
| JP | 02-183265 | A | 7/1990 |
| JP | 08-022136 | A | 1/1996 |
| JP | 08-146639 | A | 6/1996 |
| JP | 09-258469 | A | 10/1997 |
| JP | 10-073942 | A | 3/1998 |
| JP | 2003-105145 | A | 4/2003 |
| JP | 2003-147028 | A | 5/2003 |
| JP | 2009-288623 | * | 12/2009 |

OTHER PUBLICATIONS

Diamond, A.S., ed., Handbook of Imaging Materials, Marcel Dekker, Inc., NY (1991), pp. 395-396.*

Japanese Patent Office machine-assisted English-language translation of JP 2009-288623 (pub. Dec. 2009).*

Sekiya et al., U.S. Appl. No. 12/911,804, filed Oct. 26, 2010.

Communication dated Feb. 25, 2011, forwarding a European Search Report dated Feb. 18, 2011, in counterpart European Application No. 10014135.7-1217.

* cited by examiner

*Primary Examiner* — Janis L Dote

(74) *Attorney, Agent, or Firm* — Fitzpatrick, Cella, Harper & Scinto

(57) ABSTRACT

The electrophotographic photosensitive member includes a conductive support and an intermediate layer, a charge generation layer and a charge transport layer, which are provided on the conductive support in this order. The intermediate layer contains an ethylene-acrylic acid binary copolymer and a polyolefin resin in which repeating structural units are contained in a particular ratio.

10 Claims, 2 Drawing Sheets

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

1. Field of the Invention

The present invention relates to an electrophotographic photosensitive member, and a process cartridge and an electrophotographic apparatus each provided with the electrophotographic photosensitive member.

2. Description of the Related Art

The electrophotographic photosensitive member is basically formed of a photosensitive layer on which a latent image is to be formed by charging and exposure, and a support for supporting the photosensitive layer.

At present, a semiconductor laser has been mainly used as a light source in an electrophotographic apparatus. Further, investigations have been conducted on a material sensitive to the laser light having oscillatory wavelength of the semiconductor laser to find applications in a charge-generating material for use in a charge generation layer of the photosensitive member. Of the materials, gallium phthalocyanine which is highly sensitive to the laser light has been preferably used.

In the case where the photosensitive layer is formed directly on the support, stains on a support surface, and the unevenness of a shape and properties, and roughness of the support surface are directly reflected as film-formation roughness of the photosensitive layer. As a result, an image to be obtained may have blank dots, black dots, and image density non-uniformity. Further, in order to ensure the adhesiveness with the support, protect the photosensitive layer from being electrically broken down, and improve the carrier injection property to the photosensitive layer, an intermediate layer is often provided between the support and the photosensitive layer, instead of forming the photosensitive layer directly on the support.

In addition, the advancement of the current electrophotography is remarkable, and there is a demand for a very high technology with respect to the characteristics required in an electrophotographic photosensitive member. For example, process speed is increasing year by year, and there is an increasing demand for charging characteristics, sensitivity, and endurance stability, and the like. In particular, in recent years, there is a demand for an increase in image quality typified by coloring, and half-tone images and solid images typified by photographs are used more instead of monochromic images and images mainly composed of characters due to the coloring. Thus, the image quality thereof is increasing year by year. In particular, in the case of performing an image forming wherein a light-irradiated portion of one output image will become half-tone in the next rotation, an allowable range for a phenomenon in which the density of only a portion irradiated with light will become high (positive ghost phenomenon), or, conversely, for a phenomenon in which the density of the portion irradiated with light will become low (negative ghost phenomenon), is becoming remarkably limited. It is considered that the ghost phenomena are caused as follows. That is, the use of a charge-generating substance with high sensitivity increases the absolute number of carriers, and electrons are liable to remain in the charge generation layer and the intermediate layer, which serves as a memory. This phenomenon is remarkable particularly when a material with high sensitivity such as gallium phthalocyanine is used as the charge-generating substance.

Meanwhile, the reduction in cost and the miniaturization are advancing year by year, and there is an increasing demand for a technology of reduction such as cleanerless and pre-exposureless. In particular, the pre-exposure is not mounted in most cases at present. Thus, the level of ability to suppress a ghost phenomenon of the electrophotographic photosensitive member mounted on the electrophotographic apparatus without pre-exposure needs to be higher by several stages than that of the electrophotographic photosensitive member mounted on the electrophotographic apparatus with pre-exposure.

As a technique of suppressing ghost, an example in which polycyclic quinone, perylene, and the like are contained in an intermediate layer is disclosed (Japanese Patent Application Laid-Open No. 08-146639). Further, an example in which a metallocene compound, an electron-withdrawing compound, and a melamine resin are contained in the intermediate layer is disclosed (Japanese Patent Application Laid-Open No. 10-73942). Further, an example in which metal oxide particles and a silane coupling agent are contained in the intermediate layer is disclosed (Japanese Patent Application Laid-Open No. 08-22136). Further, an example in which metal oxide particles surface-treated with a silane coupling agent are contained in the intermediate layer is disclosed (Japanese Patent Application Laid-Open No. 09-258469). However, these examples do not have sufficient effects at the above-mentioned high ghost level. Further, an example of suppressing image defects such as black dots, using ethylene-acrylic resin in an intermediate layer, is disclosed (Japanese Patent Application Laid-Open Nos. 01-289965 and 02-183265).

Further, the above-mentioned ghost phenomenon is liable to occur particularly in an electrophotographic photosensitive member using an intermediate layer, compared with the case of forming a photosensitive layer directly on a support.

SUMMARY OF THE INVENTION

The present invention provides an electrophotographic photosensitive member that is excellent in the effect of suppressing ghost, and a process cartridge and an electrophotographic apparatus each including the electrophotographic photosensitive member.

The present invention relates to an electrophotographic photosensitive member including: a conductive support; an intermediate layer, a charge generation layer and a charge transport layer which are provided on the conductive support in this order, in which: the intermediate layer contains an ethylene-acrylic acid binary copolymer and a polyolefin resin; the polyolefin resin contains (A1), (A2) and (A3) as described below, and the mass ratio of the (A1), (A2) and (A3) satisfies a formula as described below.

$$0.01 \leqq (A2)/\{(A1)+(A2)+(A3)\}\times 100 \leqq 50 \quad 1.25 \leqq \{(A1)/(A3)\} \leqq 98$$

(A1): a repeating structural unit represented by the following formula (11):

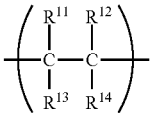

(11)

where $R^{11}$ to $R^{14}$ each independently represent a hydrogen atom or an alkyl group;

(A2): a repeating structural unit represented by one of the following formulae (21) and (22):

(21)

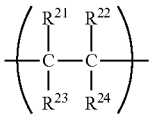

(22)

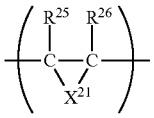

where: $R^{21}$ to $R^{24}$ each independently represent a hydrogen atom, an alkyl group, a phenyl group, or a monovalent group represented by —$Y^{21}$COOH where $Y^{21}$ represents a single bond, an alkylene group or an arylene group; $R^{25}$ and $R^{26}$ each independently represent a hydrogen atom, an alkyl group or a phenyl group; and $X^{21}$ represents a divalent group represented by —$Y^{22}$COOCO$Y^{23}$— where $Y^{22}$ and $Y^{23}$ each independently represent a single bond, an alkylene group or an arylene group, provided that at least one of $R^{21}$ to $R^{24}$ represents a monovalent group represented by —$Y^{21}$COOH; and (A3): a repeating structural unit represented by one of the following formulae (31), (32), (33) and (34):

(31)

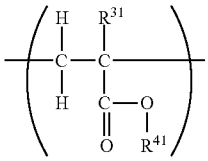

(32)

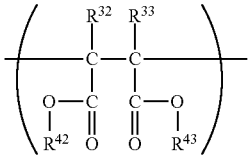

(33)

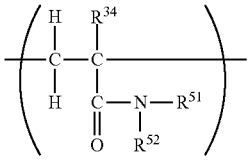

(34)

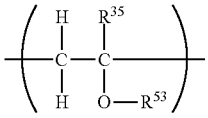

where $R^{31}$ to $R^{35}$ each independently represent a hydrogen atom or a methyl group; $R^{41}$ to $R^{43}$ each independently represent an alkyl group having 1 to 10 carbon atoms; and $R^{51}$ to $R^{53}$ each independently represent a hydrogen atom or an alkyl group having 1 to 10 carbon atoms.

Furthermore, the present invention is a process cartridge, including: the electrophotographic photosensitive member; and at least one unit selected from the group consisting of charging unit, developing unit, transfer unit and cleaning unit, in which the process cartridge integrally supports the electrophotographic photosensitive member and the at least one unit, and is attachable to and detachable from a main body of an electrophotographic apparatus.

Further, the present invention also relates to an electrophotographic apparatus including the electrophotographic photosensitive member, charging unit, exposing unit, developing unit and transfer unit.

According to the present invention, it is possible to provide an electrophotographic photosensitive member that is excellent in the effect of suppressing ghost, and a process cartridge and an electrophotographic apparatus each including the electro photographic photosensitive member.

Further features of the present invention will become apparent from the following description of exemplary embodiments with reference to the attached drawings.

DESCRIPTION OF THE EMBODIMENTS

Figure 1:
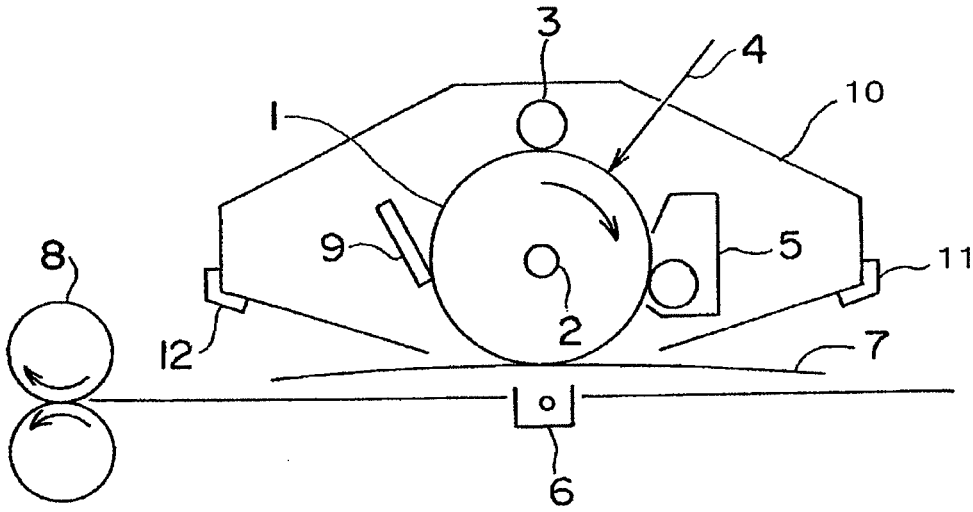
FIG. 1 is a view illustrating an example of a schematic configuration of an electrophotographic apparatus provided with a process cartridge including an electrophotographic photosensitive member of the present invention.

The electrophotographic photosensitive member of the present invention includes: a support; an intermediate layer, a charge generation layer and a charge transport layer which are provided on the support in this order, in which the intermediate layer contains an ethylene-acrylic acid binary copolymer and a specific polyolefin resin.

The ethylene-acrylic acid binary copolymer used in the present invention refers to a resin synthesized by copolymerizing ethylene and acrylic acid that are monomers each having a carbon-carbon double bond as raw materials.

Furthermore, the specific olefin resin used in the present invention refers to a resin being synthesized by polymerizing monomers each having a double bond and containing (A1), (A2) and (A3) as described below.

(A1): a repeating structural unit represented by the following formula (11).

(11)

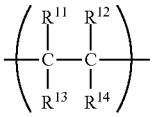

where $R^{11}$ to $R^{14}$ each independently represent a hydrogen atom or an alkyl group; it is preferred that $R^{11}$ to $R^{14}$ each independently represent a hydrogen atom or an alkyl group having 1 to 6 carbon atoms; and it is more preferred that all of $R^{11}$ to $R^{14}$ represent a hydrogen atom.

(A2): a repeating structural unit represented by one of the following formulae (21) and (22):

(21)

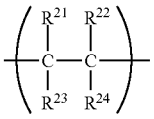

-continued (22)

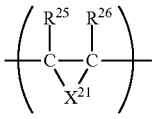

where $R^{21}$ to $R^{24}$ each independently represent a hydrogen atom, an alkyl group, a phenyl group, or a monovalent group represented by —$Y^{21}$COOH where $Y^{21}$ represents a single bond, an alkylene group or an arylene group; $R^{25}$ and $R^{26}$ each independently represent a hydrogen atom, an alkyl group or a phenyl group; and $X^{21}$ represents a divalent group represented by —$Y^{22}$COOCO$Y^{23}$— where $Y^{22}$ and $Y^{23}$ each independently represent a single bond, an alkylene group or an arylene group, provided that at least one of $R^{21}$ to $R^{24}$ represents a monovalent group represented by —$Y^{21}$COOH, it is preferred that the alkyl group and alkylene group preferably have 1 to 7 carbon atoms, and it is more preferred that three of $R^{21}$ to $R^{24}$ each represent a hydrogen atom and the other represents —COOH, or $R^{25}$ and $R^{26}$ each represent a hydrogen atom and $X^{21}$ represents —COOCO—.

(A3): a repeating structural unit represented by one of the following formulae (31), (32), (33) and (34):

(31)

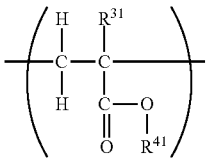

(32)

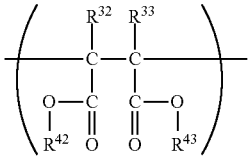

(33)

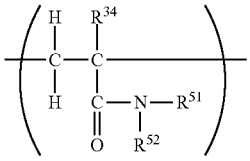

(34)

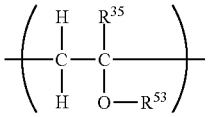

where $R^{31}$ to $R^{35}$ each independently represent a hydrogen atom or a methyl group; $R^{41}$ to $R^{43}$ each independently represent an alkyl group having 1 to 10 carbon atoms; and $R^{51}$ to $R^{53}$ each independently represent a hydrogen atom or an alkyl group having 1 to 10 carbon atoms. It is preferred that the alkyl group have 1 to 4 carbon atoms, and it is more preferred that the repeating structure unit is represented by the formula (31) and $R^{41}$ represents a methyl group or an ethyl group.

In the formulae (11), (21), (22) and (31) to (34), chemical formulae after the polymerization are shown. It should be noted that, in Examples of the present invention, the compositions of the polyolefin resins (B-1) to (B-19) are expressed using the names of, monomers before the polymerization.

Furthermore, the polyolefin resin used in the present invention is characterized in that the mass ratio of the (A1), (A2) and (A3) contained in the polyolefin resin satisfies the formulae as described below.

$$0.01 \leqq (A2)/\{(A1)+(A2)+(A3)\}\times 100 \leqq \mathbf{50}\ 1.25 \leqq \{(A1)/(A3)\} \leqq 98$$

Although the detailed reason that the electrophotographic characteristics such as a ghost, other fluctuation by an environment, and a fluctuation by duration are improved by allowing the intermediate layer to contain an ethylene-acrylic acid binary copolymer and the polyolefin resin is unclear, the inventors of the present invention reason the following.

The ethylene-acrylic acid binary copolymer is a copolymer of ethylene and acrylic acid, i.e., monomers having polarities largely different from each other, and even in a single copolymer molecular chain and film of the intermediate layer, a portion with small polarity made of an ethylene moiety and a portion with large polarity made of an acrylic acid moiety are present in a minute area. The difference in polarity serves as a trap of carriers, and serves as a factor for changing the chargeability and carrier movement speed to degrade the electrophotographic characteristics.

The polyolefin resin used in the present application contains (A1), (A2) and (A3) as repeating structural units that alleviate the difference in polarity between the ethylene and acrylic acid moieties, and is assumed to improve the electrophotographic characteristics by decreasing the difference in polarity in a minute area in a film in the intermediate layer.

Furthermore, (A1), (A2) and (A3) of the polyolefin resin do not improve the electrophotographic characteristics such as a ghost, other fluctuation by an environment, and a fluctuation by duration by single repeating structural units, and respective repeating structural units having different polarities fall within the range of an appropriate mass ratio as shown in the present invention. Thus, the effects can be obtained. It is considered that, in the appropriate range, a large change in polarity is alleviated and the number of traps for carriers is reduced in a film in which an intermediate layer is formed together with an ethylene-acrylic acid binary copolymer as well as in a molecular chain of a single polyolefin resin.

When the mass ratio of the (A2) with respect to the total (A1), (A2) and (A3), that is, {(A1)+(A2)+(A3)}, is less than 0.01, a fluctuation by duration is liable to occur, and the effects of the present invention are not exhibited. On the other hand, when the mass ratio exceeds 50, a ghost and a fluctuation by an environment are liable to occur, and the effects of the present invention are not exhibited. In order to render the effects of the present invention more excellent, the mass ratio is preferably in the range of 0.01 to 10, or more preferably in the range of 0.01 to 5.

When the mass ratio of the (A1) with respect to the (A3) is less than 1.25, the fluctuation by an environment is liable to occur, and the effects of the present invention are not exhibited. On the other hand, when the mass ratio exceeds 98, the fluctuation by duration is liable to occur, and the effects of the present invention are not exhibited.

In the present invention, it is preferred that the amount of the ethylene-acrylic acid binary copolymer contained in the intermediate layer be 5 to 60 mass%. Further, it is preferred that the content of the polyolefin resin contained in the intermediate layer be 17.5 to 95 mass %. It should be noted that the ethylene-acrylic acid binary copolymer and the polyolefin resin contained in the intermediate layer can be used at any mass ratio if both of the components are used. The mass ratio of 5/95≦(ethylene-acrylic acid binary copolymer)/(polyolefin resin)≦60/40 is preferred. It is preferred to use an intermediate layer satisfying such mass ratio particularly because the effect of suppressing a fluctuation by an environment is exhibited. It is more preferred that the mass ratio be 10/90≦(ethylene-acrylic acid binary copolymer)/(polyolefin resin)≦40/60 because the above-mentioned effect is enhanced further.

Further, in the present invention, in order to enhance the above-mentioned effect, it is preferred that the mass ratio of the repeating structural unit formed of acrylic acid in the ethylene-acrylic acid binary copolymer contained in the intermediate layer be larger than the mass ratio of the (A2) in the polyolefin resin contained in the intermediate layer.

The polyolefin resin used in the present invention contains the (A1), (A2) and (A3). Each repeating structural unit in the polyolefin resin is obtained by polymerizing a compound having a vinyl group as a monomer. For example, ethylene that is an example of a monomer for forming the (A1) is an alkene having 2 carbon atoms, and ethylene as a monomer is polymerized to form a repeating structural unit of the polyolefin resin of the present invention.

The examples of the (A1), (A2) and (A3), the formulae (11), (21), (22) and (31) to (34), and the polyolefin resins (B-1) to (B-19) are described using the names of the monomers before the copolymerization, and the resin obtained by polymerizing these monomers is referred to as the polyolefin resin.

The monomer for forming the (A2) is a compound having at least one or both of a carboxylic acid group and a carboxylic anhydride group in the compound molecule (in the monomer unit). The compound having at least one of an unsaturated carboxylic acid group and a carboxylic anhydride group is preferably one or both of an unsaturated carboxylic acid and an anhydride thereof. Specific examples thereof include acrylic acid, methacrylic acid, maleic acid, maleic anhydride, itaconic acid, itaconic anhydride, fumaric acid, and crotonic acid, and a half ester and a half amide of an unsaturated dicarboxylic acid. Of those, acrylic acid, methacrylic acid, maleic acid, and maleic anhydride are preferred, and maleic anhydride is particularly preferred.

Further, the compound having at least one of a carboxylic acid group and a carboxylic anhydride group is contained in the polyolefin resin as a copolymer. The form of the copolymer is not particularly limited, and examples thereof include a random copolymer, a block copolymer, and a graft copolymer.

It should be noted that the unsaturated carboxylic anhydride such as maleic anhydride forms an acid anhydride structure in which adjacent carboxyl groups are cyclodehydrated in a dry state of a resin. However, for example, in an aqueous medium containing a basic compound, a part or the entirety thereof undergoes ring-opening to easily form a structure of carboxylic acid or a salt thereof.

Further, in the present invention, in the case where the amount of a compound having a carboxylic acid group or a carboxylic anhydride group based on the amount of a carboxyl group in a resin is defined, the amount is determined assuming that all the carboxylic anhydride groups in the resin undergo ring-opening to form carboxyl groups.

Examples of the monomer for forming the (A1) include an alkene having 2 to 6 carbon atoms, such as ethylene, propylene, isobutylene, 1-butene, 1-pentene, and 1-hexene. The monomers can be used alone or as a mixture.

Of those, an alkene having 2 to 4 carbon atoms, such as ethylene, propylene, isobutylene, and 1-butene, is more preferred, and ethylene is particularly preferred.

Examples of the monomer for forming the (A3) include the following compounds each having a vinyl group.

Examples of the compound include: (meth)acrylic esters such as methyl (meth)acrylate, ethyl (meth)acrylate, and butyl (meth)acrylate represented by the formula (31); maleic esters such as dimethyl maleate, diethyl maleate, and dibutyl maleate represented by the formula (32); (meth)acrylic acid amides represented by the formula (33); alkyl vinyl ethers such as methyl vinyl ether and ethyl vinyl ether represented by the formula (34); and vinyl alcohols obtained by saponifying vinyl esters with a basic compound.

It should be noted that the compounds can be used alone or as a mixture. Of those, (meth)acrylic acid esters represented by the formula (31) are preferred, and methyl (meth)acrylate or ethyl (meth)acrylate is more preferred.

The polyolefin resin used in the present invention is particularly preferably a ternary copolymer formed of ethylene, methyl (meth)acrylate or ethyl (meth)acrylate, and maleic anhydride. Specific examples of the ternary copolymer include an ethylene-maleic anhydride-acrylate ternary copolymer and an ethylene-maleic anhydride-methacrylate ternary copolymer.

The polyolefin resin used in the present invention may contain a repeating structural unit other than those described above as a repeating structural unit of the copolymer to such an extent that the effect of the present invention is not impaired. Specific examples of the monomer for forming other repeating structural units include dienes, (meth)acrylonitrile, vinyl halides, vinylidene halides, carbon monoxide, and carbon disulfide. It should be noted that the total mass ratio (%) of the (A1), (A2), and (A3) in the polyolefin resin is preferably 90% to 100%.

Further, the intermediate layer used in the present invention may contain metal oxide particles, if required, and a volume ratio (%) of the metal oxide particles in the entire intermediate layer is preferably 25 to 80%. The kind of the metal oxide particles is not particularly limited as long as they are generally used in an intermediate layer of an electrophotographic photosensitive member. Carbon black, metal particles and metal oxide particles can be used, and it is preferred to use a material containing at least one kind of metal oxide (conductive metal oxide) selected from the group consisting of titanium oxide, zinc oxide and tin oxide.

The metal oxide particles are considered to have carrier transferability. In particular, in the case of using the ethylene-acrylic acid binary copolymer and olefin resin of the present invention, the improvement of a ghost level was observed.

The molecular weight of the polyolefin resin used in the present invention is not particularly limited and a method of synthesizing the polyolefin resin is also not particularly limited. The polyolefin resin can be obtained by, for example, subjecting monomers for forming the polyolefin resin to high-pressure radical copolymerization in the presence of a radical generator.

In addition, any one of the known methods described in the chapters 1 to 4 of "New Polymer Experiment 2 Synthesis and Reaction of Polymer (1)" (Kyoritsu Shuppan Co., Ltd.), Japanese Patent Application Laid-Open No. 2003-105145, and Japanese Patent Application Laid-Open No. 2003-147028 can be employed as a specific method of synthesizing the polyolefin resin.

In the present invention, the characteristics of the resin were measured or evaluated by the following method.

(1) Content of the (A2) (Unsaturated Carboxylic Acid Unit) in Olefin Resin

The acid value of an olefin resin was measured in accordance with JIS K5407, and the content (graft ratio) of an unsaturated carboxylic acid was obtained from the measured acid value in accordance with the following expression:

Content of unsaturated carboxylic acid unit(mass %)=
(Mass of grafted unsaturated carboxylic acid)/
(Mass of olefin resin as raw material)×100

(2) Configuration of Resin Other than the (A2) in Olefin Resin

The configuration of a resin was obtained by performing 1H-NMR and 13C-NMR analysis (300 MHz, produced by Varian Technologies Japan Limited) at 120° C. in orthodichlorobenzene (d4). In the 13C-NMR analysis, measurement was conducted by a gate-induced decoupling method considering the quantitativity.

A coating liquid for an intermediate layer is obtained by a method of producing a coating liquid by dissolving an ethylene-acrylic acid binary copolymer and a polyolefin resin in an appropriate solvent, a method of producing a coating liquid by holding the ethylene-acrylic acid binary copolymer and polyolefin resin at a high temperature equal to or higher than a softening point to form a molten state, and a method of producing a coating liquid by stirring the ethylene-acrylic acid binary copolymer and polyolefin resin in an appropriate solvent by heating to form a dispersion.

The coating liquid is formed into a film serving as an intermediate layer by a dip coating method, a roll coating method, a spray coating method, a curtain coating method, and a spin coating method. The dip coating method is preferred in terms of efficiency and productivity. Further, the thickness of the intermediate layer to be used in the present invention is preferably 0.1 to 3.0 μm or more preferably 0.3 to 3.0 μm.

As for the support used in the present invention, it is sufficient so long as it has conductivity (conductive support), for example, supports of metals such as aluminum, nickel, copper, gold and iron, or alloys of the metals. Further, supports each having a thin film formed of a metal such as aluminum, silver or gold, or of a conductive material such as indium oxide or tin oxide, on an insulating support of, for example, polyester, polycarbonate, polyimide or glass; and supports each obtained by dispersing carbon or a conductive filler in a resin to impart conductivity to the resin.

In addition, the shape of the support is not particularly limited, and a support of a plate shape, drum shape or belt shape is used as required.

The surface of such support may be subjected to an electrochemical treatment such as anodization or a chemical treatment involving the use of a solution prepared by dissolving a compound of a metal salt or a metal salt of a fluorine compound in an acidic aqueous solution mainly formed of an alkaline phosphate, phosphoric acid, or tannic acid in order that the electrical characteristics of the support, or adhesiveness between the support and the intermediate layer may be improved.

In addition, when the electrophotographic photosensitive member is used in a printer using laser light beams having a single wavelength, the surface of the support is preferably roughened to a moderate extent so that interference fringes may be suppressed. That is, the surface of the support is preferably treated by horning, blasting, cutting, or electrolytic polishing. Alternatively, a support having a conductive layer formed of a conductive metal oxide particle and a binder resin is preferably formed on a support formed of aluminum or an aluminum alloy.

Methods for the horning treatment are classified into a dry method and a wet method, and any one of the methods may be employed in the present invention. A wet horning treatment is a method involving suspending a powdery abrasive in a liquid such as water and spraying the suspension on the surface of the support at a high speed to roughen the surface. The surface roughness of the support can be controlled depending on the pressure and speed at which the suspension is sprayed, the amount, kind, shape, size, hardness, and specific gravity of the abrasive, and the temperature at which the abrasive is suspended.

Meanwhile, a dry horning treatment is a method involving spraying an abrasive on the surface of the support at a high speed with air to roughen the surface, and the surface roughness can be controlled by the same method as in the case of the wet horning treatment. Examples of the abrasive used in the wet or dry horning treatment include particles each formed of silicon carbide, alumina, or iron, and glass beads.

When a support is obtained by applying the conductive layer formed of the conductive metal oxide particle and the binder resin on the support formed of aluminum or an aluminum alloy, the incorporation of the conductive metal oxide particle into the conductive layer provides an effect for suppressing interference fringes by irregularly reflecting the laser light beams, and an effect for hiding flaws in, and protruded portions on, the surface of the support before application.

As for the conductive metal oxide particle, a material containing zinc oxide, titanium oxide or barium sulfate is exemplified. In addition, each of the conductive metal oxide particles can be coated with tin oxide as required so that the particles may serve as a filler having a proper resistivity.

The resistivity of the conductive metal oxide particles is preferably 0.1 to 1000 Ω·cm, or more preferably 1 to 1000 Ω·cm. In the present invention, the resistivity of the conductive metal oxide particles was measured with a resistance-measuring apparatus (Loresta AP (trade name) manufactured by Mitsubishi Chemical Corporation). The conductive metal oxide particles as measuring objects were compacted at a pressure of 500 kg/cm$^2$ to be turned into a coin-shaped sample, and the sample was mounted on the resistance-measuring apparatus.

In addition, the average particle diameter of the conductive metal oxide particles is preferably 0.05 to 1.0 μm, or more preferably 0.07 to 0.7 μm. In the present invention, the average particle diameter of the conductive metal oxide particles is a value measured by a centrifugal sedimentation method.

Further, the content of the conductive metal oxide particles in the conductive layer is preferably 1.0 to 90 mass %, or more preferably 5.0 to 80 mass % with respect to the total mass of the conductive layer. The conductive layer may contain fluorine or antimony as required.

Examples of the binder resin used in the conductive layer include a phenol resin, polyurethane, polyamide, polyimide, polyamide-imide, polyamic acid, polyvinyl acetal, an epoxy resin, an acrylic resin, a melamine resin and polyester. These resins can be used as single or in combination. Any such resin is preferably used because the resin improves the adhesiveness of the conductive layer to the conductive support, the dispersing performance of the conductive metal oxide particles, and the solvent resistance of the layer after its formation. Of the above-mentioned resins, a phenol resin, polyurethane, or polyamic acid is particularly preferred. The content of the binder resin is preferably 20 to 70 mass % with respect to the conductive layer.

The conductive layer can be formed through, for example, dip coating or solvent application with a Meyer bar. The thickness of the conductive layer is preferably 0.1 to 30 μm, or more preferably 0.5 to 20 μm. In addition, the volume resistivity of the conductive layer is preferably $1.0\times10^{5}$ Ω·cm or more and $1.0\times10^{13}$ Ω·cm or less, or more preferably $1.0\times10^{5}$ Ω·cm or more and $1.0\times10^{12}$ Ω·cm or less. In the present invention, the volume resistivity was determined by forming the conductive layer as a measuring object on an aluminum plate, further forming a thin film formed of gold on the conductive layer, and measuring a current flowing between both electrodes, i.e., the aluminum plate and the thin film formed of gold with a pA meter. Further, a leveling agent may be added to the conductive layer for improving the surface characteristic of the layer.

The electrophotographic photosensitive member of the present invention has the support, the intermediate layer provided on the support, and the charge generation layer and the charge transport layer provided on the intermediate layer.

The charge generation layer is formed containing a charge-generating substance and other components such as a binder resin. The charge generation layer can be formed, for example, by dissolving a binder resin in a solvent in an amount of 0.3 to 4 times that of the charge-generating substance in terms of mass ratio, adding a charge-generating substance to the mixture, and applying a coating liquid for a charge generation layer obtained by dispersing the charge-generating substance, followed by drying. The charge-generating substance is dispersed by a media type disperser such as a sand mill or a ball mill, or a disperser such as a liquid collision type disperser. In the present invention, it is preferred that the thickness of the charge generation layer is in the range of 0.05 to 1.0 μm.

Examples of the charge-generating substance include pyrylium-based dyes, thiopyrylium-based dyes, phthalocyanine-based pigments, anthanthrone-based pigments, dibenzpyrenequinone-based pigments, pyranthrone-based pigments, azo-based pigments, indigo-based pigments, quinacridone-based pigments, and quinocyanine-based pigments. Of those, phthalocyanine-based pigments are preferred. Examples of the phthalocyanine-based pigments include non-metallic phthalocyanines, oxytitanium phthalocyanine, hydroxygallium phthalocyanine, and halogenated gallium phthalocyanines such as chlorogallium phthalocyanine. Those charge-generating substances may be used alone or in combination.

In the charge generation layer, when mixing a phthalocyanine-based pigment and a charge-generating substance other than phthalocyanine-based pigments, it is also possible to contain 50 mass % or less of the charge-generating substance other than phthalocyanine-based pigments with respect to the total charge-generating substances.

Examples of the binder resin include, a butyral resin, a polyester resin, a polycarbonate resin, a polyarylate resin, a polystyrene resin, a polyvinyl methacrylate resin, a polyvinyl acrylate resin, a polyvinyl acetate resin, a polyvinyl chloride resin, a polyamide resin, a polyurethane resin, a silicone resin, an alkyd resin, an epoxy resin, a cellulose resin, and a melamine resin. Of those, a butyral resin is particularly preferred.

The charge transport layer contains a charge-transporting substance in a molecule dispersed state and a binder resin, and is preferably formed by applying a solution in which a binder resin having film formation property and a charge-transporting substance as described below are dissolved, followed by drying. Further, in the present invention, the thickness of the charge transport layer is preferably in the range of 5.0 to 50 μm.

Examples of the charge-transporting substance include, but are not limited to, hole transporting compounds, such as polycylic aromatic compounds, heterocylic compounds, hydrazone-based compounds, styryl-based compounds, benzidine-based compounds, triarylamine-based compounds and triphenylamine, and a polymer having a group formed of those compounds in the main chain or side chain.

Further, examples of the binder resin used in the charge transport layer include, but are not limited to, polyester, polycarbonate, polymethacrylate, polyarylate, polysulfone, and polystyrene. Of those, polycarbonate and polyarylate are particularly preferred. In the charge transport layer of the present invention, the content of the charge-transporting substance is preferably 0.5 to 3.0 times with respect to the binder resin in terms of mass ratio.

A process cartridge of the present invention includes the electrophotographic photosensitive member of the present invention and at least one unit selected from the group consisting of charging unit, developing unit, transfer unit and cleaning unit, in which the process cartridge integrally supports the electrophotographic photosensitive member and the at least one unit, and is attachable to and detachable from a main body of an electrophotographic apparatus.

Further, the electrophotographic apparatus of the present invention includes the electrophotographic photosensitive member of the present invention, charging unit, exposing unit, developing unit and transfer unit.

FIG. 1 illustrates an example of the schematic configuration of the electrophotographic apparatus provided with the process cartridge including an electrophotographic photosensitive member of the present invention.

In FIG. 1, a drum-shaped electrophotographic photosensitive member 1 is rotated around a shaft 2 in the direction indicated by an arrow at a predetermined circumferential speed. The circumferential surface of the electrophotographic photosensitive member 1 thus rotated is uniformly charged to a predetermined negative potential by charging unit 3 (primary charging unit), and then receives exposure light (image exposure light) 4 output from exposing unit (not shown) such as slit exposure or laser beam scanning exposure. Thus, electrostatic latent images corresponding to a target image are sequentially formed on the circumferential surface of the electrophotographic photosensitive member 1. A voltage applied to the charging unit 3 may be a voltage obtained by superimposing an AC component on a DC component, or may be a voltage formed only of a DC component.

The electrostatic latent images formed on the circumferential surface of the electrophotographic photosensitive member 1 are each developed with toner from developing unit 5 to serve as a toner image. Next, the toner images formed on and carried by the circumferential surface of the electrophotographic photosensitive member 1 are sequentially transferred by a transferring bias from transfer unit 6 (transfer roller). A transfer material 7 (such as paper) is taken out of transfer material-feeding unit (not shown) to be fed to a portion between the electrophotographic photosensitive member 1 and the transfer unit 6 (abutting portion) in synchronization with the rotation of the electrophotographic photosensitive member 1. The transfer material 7 onto which the toner images have been transferred is separated from the circumferential surface of the electrophotographic photosensitive member 1, and is then introduced into fixing unit 8 to undergo image fixation. As a result, the transfer material as an image-formed product (a print or copy) is printed out of the apparatus.

A transfer residual developer (toner) is removed from the surface of the electrophotographic photosensitive member 1 after the transfer of the toner images by cleaning unit 9 (cleaning blade) so that the surface may be cleaned before the electrophotographic photosensitive member is repeatedly used for image formation. It should be noted that, for example, transfer unit based on an intermediate transfer system using a belt- or drum-shaped intermediate transfer body may be adopted as the transfer unit.

In FIG. 1, the electrophotographic photosensitive member 1, the charging unit 3, the developing unit 5 and the cleaning unit 9 are integrally supported to serve as a process cartridge 10 attachable to and detachable from the main body of the electrophotographic apparatus with the aid of guiding unit 11,12 such as a rail of the main body of the electrophotographic apparatus.

EXAMPLES

Hereinafter, the present invention is described specifically by way of examples. However, the present invention is not limited thereto. It should be noted that the word "parts" in the following compounding represents "parts by mass".

Polyolefin resins (B-1) to (B-19) containing (A1) type, (A2) type and (A3) were synthesized, in accordance with the repeating structural unit constitution and mass ratios (%) shown in Table 1 below. The resins were synthesized using known methods described in Chapters 1 to 4 of "New Polymer Experiment 2 Synthesis and Reaction of polymer (1)" published by Kyoritsu Shuppan Co., Ltd., Japanese Patent Application Laid-Open No. 2003-105145, Japanese Patent Application Laid-Open No. 2003-147028, and the like.

TABLE 1

| Resin | Ratio of (A1) component to polyolefin | Monomer for forming (A1) component | Ratio of (A2) component to polyolefin | Monomer for forming (A2) component | Ratio of (A3) component to polyolefin | Monomer for forming (A3) component |
|---|---|---|---|---|---|---|
| B-1 | 70.00 | Ethylene | 20.00 | Maleic anhydride | 10.00 | Ethyl acrylate |
| B-2 | 30.00 | Ethylene | 46.00 | Maleic anhydride | 24.00 | Ethyl acrylate |
| B-3 | 98.00 | Ethylene | 1.00 | Maleic anhydride | 1.00 | Ethyl acrylate |
| B-4 | 70.00 | Ethylene | 20.00 | Maleic anhydride | 10.00 | Methyl acrylate |
| B-5 | 70.00 | Ethylene | 20.00 | Acrylic acid | 10.00 | Dimethyl maleate |
| B-6 | 70.00 | Ethylene | 20.00 | Acrylic acid | 10.00 | Acrylamide |
| B-7 | 70.00 | Ethylene | 20.00 | Acrylic acid | 10.00 | Ethyl vinyl ether |
| B-8 | 64.00 | Propene | 19.00 | Maleic anhydride | 15.00 | Ethyl acrylate |
| B-9 | 58.00 | 1-hexene | 22.00 | Maleic anhydride | 20.00 | Ethyl acrylate |
| B-10 | 70.00 | Ethylene | 13.00 | Maleic anhydride | 17.00 | Ethyl acrylate |
| B-11 | 80.00 | Ethylene | 10.00 | Maleic anhydride | 10.00 | Ethyl acrylate |
| B-12 | 75.00 | Ethylene | 5.00 | Maleic anhydride | 10.00 | Ethyl acrylate |
| B-13 | 79.00 | Ethylene | 3.00 | Maleic anhydride | 18.00 | Ethyl acrylate |
| B-14 | 60.00 | Ethylene | 1.00 | Maleic anhydride | 39.00 | Ethyl acrylate |
| B-15 | 80.00 | Ethylene | 0.01 | Maleic anhydride | 19.99 | Ethyl acrylate |
| B-16 | 55.00 | Ethylene | 35.00 | Maleic anhydride | 10.00 | Ethyl acrylate |
| B-17 | 60.00 | Ethylene | 0.00 | None | 40.00 | Ethyl acrylate |
| B-18 | 30.00 | Ethylene | 55.00 | Maleic anhydride | 15.00 | Ethyl acrylate |
| B-19 | 36.00 | Ethylene | 34.00 | Maleic anhydride | 30.00 | Butyl acrylate |

Example 1

30 parts of ESCOR 5200 (Exxon Mobil Corporation) in which the mass ratio of acrylic acid was 15 mass% as an ethylene-acrylic acid binary copolymer were dissolved in 270 parts of cyclohexanone by heating to obtain an ethylene-acrylic acid binary copolymer solution.

Separately, 75.0 parts of the polyolefin resin (B-1), 60.0 parts of 2-propanol (hereinafter referred to as "IPA"), 5.1 parts of triethylamine (hereinafter referred to as "TEA"), and 159.9 parts of distilled water were loaded into a sealable, pressure-resistant glass container provided with a stirring machine and a heater and having a volume of one liter, and the mixture was stirred while the rotational speed of a stirring blade was set to 300 rpm. As a result, no granular resin precipitate was observed at the bottom of the container, but the resin was observed to be in a floating state. Here, 10 minutes after the observation, the heater was turned on to heat the mixture while the state was maintained. Then, the mixture was stirred for additional 20 minutes while the temperature in the system was kept at 140 to 145° C. After that, the system was immersed in a water bath, and the temperature in the system was lowered to room temperature (25° C.) while the mixture was stirred with the rotational speed kept at 300 rpm. After that, the mixture was filtrated with a 300-mesh stainless filter (wire diameter of 0.035 mm, plain weave) under pressure (at an air pressure of 0.2 MPa). As a result, an opaque, uniform polyolefin resin solution was obtained.

65 parts of the ethylene-acrylic acid binary copolymer and 14 parts of the polyolefin resin solution were mixed, and thus, a coating liquid for an intermediate layer with a mass ratio between the ethylene-acrylic acid binary copolymer and the polyolefin resin of 65/35 was obtained.

An aluminum blank tube (ED tube: JIS-A3003) having an outer diameter of 30.5 mm, an inner diameter of 28.5 mm, and a length of 260.5 mm obtained by hot extrusion was prepared.

A solution formed of 120 parts of barium sulfate particles each having a coat layer formed of tin oxide (coverage 50 mass %, powder resistivity 700 Ω·cm), 70 parts of a resol type phenol resin (Plyophen J-325 (trade name), manufactured by DIC Corporation, solid content 700), and 100 parts of 2-methoxy-1-propanol was prepared, and the solution was subjected to a dispersion treatment with a ball mill for 20 hours. As a result, a coating liquid for a conductive layer was prepared (the average particle diameter of the powder in the coating liquid was 0.22 μm).

The liquid was applied onto the aluminum blank tube by dip coating, and cured by heating at 140° C. for 30 minutes. Thus, a conductive layer with a thickness of 15 μm was formed and used as a support (a conductive support).

The coating liquid for an intermediate layer was applied to the obtained support by dip coating, followed by drying at 120° C. for 10 minutes. Thus, an intermediate layer with a thickness of 0.3 μm was formed.

Next, 10 parts of a polyvinyl butyral resin (BX-1 (trade name) manufactured by SEKISUI CHEMICAL CO., LTD.) and 350 parts of cyclohexanone were added to 20 parts of a hydroxygallium phthalocyanine crystal as a charge-generating material, and the mixture was subjected to a dispersion treatment with a sand mill using glass beads each having a diameter of 1 mm for 3 hours. Then, 1200 parts of ethyl acetate were added to dilute the mixture. As a result, a coating liquid for a charge generation layer was obtained. The dispersion particle diameter of the charge-generating material in the coating liquid for a charge generation layer measured with a natural/centrifugal sedimentation type particle size distribution-measuring apparatus (CAPA-700, manufactured by HORIBA, Ltd.) was 0.15 μm. The coating liquid for a charge generation layer was applied onto the intermediate layer by dip coating, was then dried for 10 minutes at 100° C., and as a result, a charge generation layer having a thickness of 0.18 μm was formed.

Next, 7 parts of a compound represented by the following structural formula (7), 1part of a compound represented by the following structural formula (8), and 10 parts of a bisphenol C type polyallylate resin (having a weight-average molecular weight [Mw] of 110,000) were dissolved in a mixed solvent formed of 50 parts of monochlorobenzene and 10 parts of dichloromethane. As a result, a coating liquid for a charge transport layer was prepared. The coating liquid for a charge transport layer was applied onto the charge generation layer by dip coating, and was then dried for 1 hour at 110° C. As a result, a charge transport layer having a thickness of 18 μm was formed. Thus, the electrophotographic photosensitive member was produced.

(7)

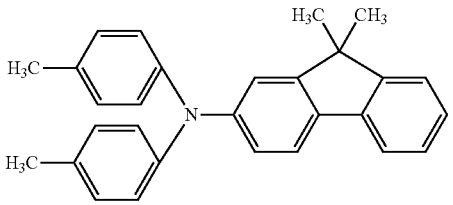

(8)

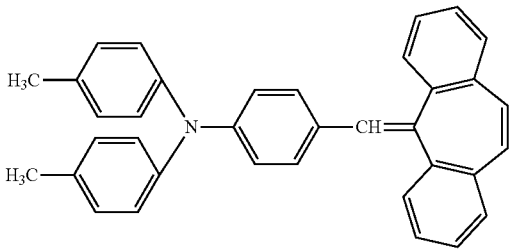

Methods of evaluating the electrophotographic photosensitive member are as described below.

Figure 2:
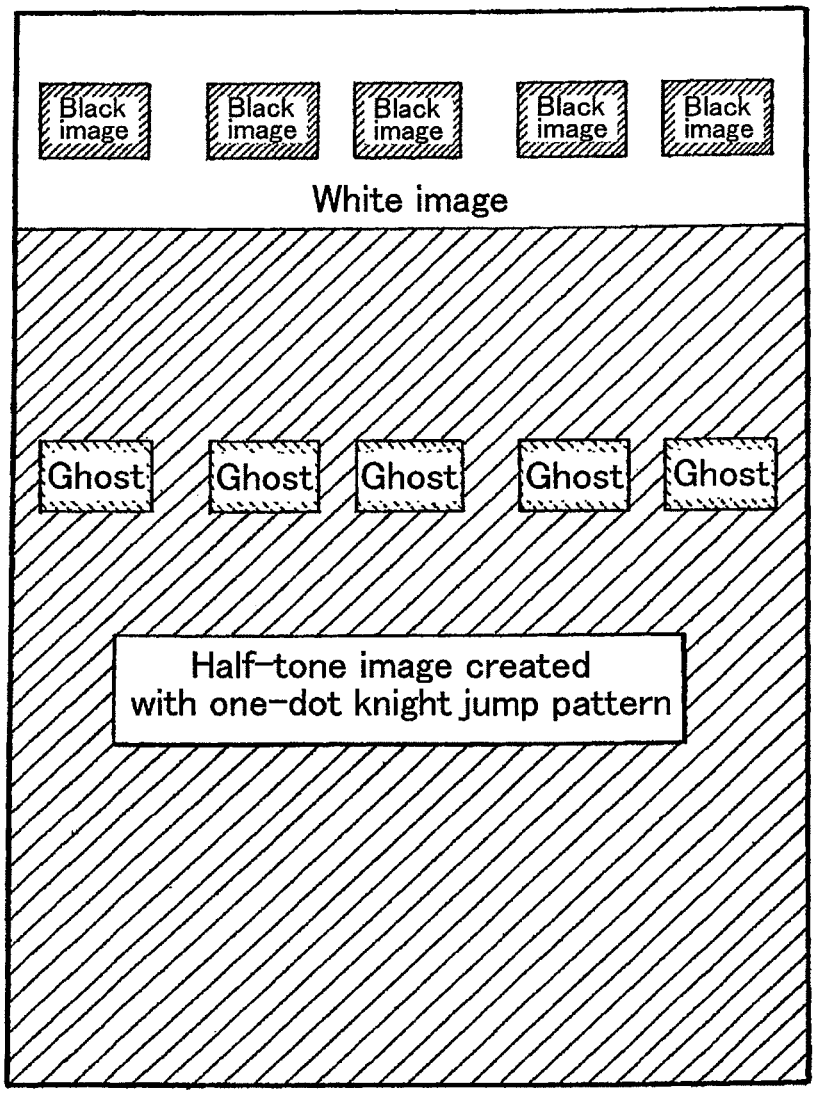
FIG. 2 is a view illustrating an image for evaluating a ghost phenomenon used in Examples.

The light potential of the electrophotographic photosensitive member produced in the foregoing under a normal-temperature, normal-humidity environment of 23° C. and 50% RH was measured with a reconstructed apparatus of a color laser printer LaserJet 4600 (trade name) manufactured by Hewlett-Packard Company (charging (first charging): roller contact DC charging (applying voltage of only a DC component to the charging roller), dark potential −500 V, process speed 100 mm/sec, laser exposure, light quantity 0.3 μJ/cm$^2$), and the light potential was defined as the sensitivity of the electrophotographic photosensitive member. In addition, the light potential of the electrophotographic photosensitive member under a low-temperature, low-humidity environment of 15° C. and 10% RH was measured, and then images each having an image density of 4% were output on 3000 sheets. Then, the light potential was measured again to evaluate ghost phenomena. The images for evaluating ghost phenomena were created in monochromic colors of magenta, cyan, yellow, and black, respectively. For example, in the case of black, as illustrated in FIG. 2, black square images were output on the leading end of an image, and after that, a half-tone image was created with one-dot knight jump pattern. The order of creating images was as follows. That is, a solid white image was output on a first sheet, images for evaluating ghost phenomena were continuously output on five sheets. Next, a solid black image was output on one sheet, and then images for evaluating ghost phenomena were output on five sheets again. Thus, a total of ten sheets of images for evaluating ghost phenomena were evaluated.

The evaluation of the images for evaluating ghost phenomena was performed as follows.

A: No ghost is observed

B: Ghost is observed slightly in five or less sheets of the evaluated images

C: Ghost is observed slightly in all the evaluated images

D: No problem in the case where high image quality is not required, although ghost is observed E: Ghost is observed clearly The difference between the light potential under the normal-temperature, normal humidity environment and the light potential under the low-temperature, low-humidity environment was defined as a fluctuation by an environment and the difference in light potential before and after the image output was defined as a fluctuation in potential by duration. It should be noted that the fluctuation by an environment is preferably less than 20 V and the fluctuation by duration is preferably less than 35 V. When the fluctuation by an environment and the fluctuation by duration are large, a variation in density among the resultant images becomes large, and thus, the fluctuation by an environment and the fluctuation by duration are more preferably 15 V or less and 22 V or less, respectively. Further, in the case where the stability of an image density is required, the fluctuation by an environment and the fluctuation by duration are 10 V or less and 15 V or less, respectively. The fluctuation by an environment and the fluctuation by duration are described based on the following ranks.

Fluctuation by an environment: Rank A=5 V or less, Rank B=10 V or less, Rank C=15 V or less, Rank D=less than 20 V, and Rank E=20 V or more Fluctuation by duration: Rank A=10 V or less, Rank B=15 V or less, Rank C=22 V or less, Rank D=less than 35 V, and Rank E=35 V or more.

Table 2 shows the results.

Example 2-25

Electrophotographic photosensitive members as Examples 2 to 25 were produced and evaluated in the same way as in Example 1, except that the ethylene-acrylic acid binary copolymer and the polyolefin resin of the intermediate layer were mixed at a mass ratio shown in Table 2 and polyolefin species shown in Table 2 were used. Table 2 shows the results. It should be noted that all the ethylene-acrylic acid binary copolymers are each the same as that in Example 1.

Example 26-29

Electrophotographic photosensitive members as Examples 26 to 29 were produced and evaluated in the same way as in Example 1, except that Escor 5100 (manufactured by Exxon Mobil Corporation) in which the mass ratio of acrylic acid was 11 mass % was used as the ethylene-acrylic acid binary copolymer, and the ethylene-acrylic acid binary copolymer and the polyolefin resin of the intermediate layer were mixed at amass ratio as shown in Table 2 and polyolefin species shown in Table 2 were used.

Example 30

0.2 mol of tin (IV) chloride pentahydrate was dissolved in 200 ml of water so that a 0.5-M aqueous solution was obtained. Then, 28% ammonia water was added to the aqueous solution while the aqueous solution was stirred. As a result, white tin oxide ultrafine particle-containing slurry having a pH of 1.5 was obtained. After the resultant tin oxide ultrafine particle-containing slurry had been heated to 70° C., the slurry was naturally cooled to around 50° C., and then pure water was added to the slurry so that one liter of tin oxide ultrafine particle-containing slurry was obtained. Then, the slurry was subjected to solid-liquid separation with a centrifugal separator. Next, 800 ml of pure water were added to the water-containing solid, and the mixture was subjected to stirring and dispersion with a homogenizer. After that, washing was performed through the solid-liquid separation of the mixture with a centrifugal separator. Then, 75 ml of pure water were added to a water-containing solid after the washing so that tin oxide ultrafine particle-containing slurry was prepared. Next, 3.0 ml of triethylamine were added to the resultant tin oxide ultrafine particle-containing slurry, and the mixture was stirred. When the mixture started to be transparent, the mixture was heated to 70° C. After that, the heating was stopped, and the mixture was naturally cooled. As a result, a tin oxide sol solution using an organic amine having a solid concentration of 20 mass % as a dispersion stabilizer was obtained.

Then, 120 parts of the tin oxide sol solution, 30 parts of an ethylene-acrylic acid binary copolymer solution synthesized in the same way as in Example 1, and 28 parts of an olefin resin solution synthesized in the same way as in Example 1 using the olefin resin B-13 were mixed to obtain a coating liquid for an intermediate layer. An electrophotographic photosensitive member was produced and evaluated in the same way as in Example 1, except for using the obtained coating liquid for an intermediate layer and setting the thickness of the intermediate layer to 0.8 μm.

Example 31

An electrophotographic photosensitive member was prepared and evaluated in the same way as in Example 30, except that 350 parts of the tin oxide sol solution were used to prepare a coating liquid for an intermediate layer.

Example 32

An electrophotographic photosensitive member was prepared and evaluated in the same way as in Example 30, except that 1050 parts of the tin oxide sol solution were used to prepare a coating liquid for an intermediate layer.

Example 33

To 100 parts of titanium oxide (MT-150A (trade name) produced by TAYCA CORPORATION) and 900 parts of methanol, 1000 parts of 1 mm glass beads were added, and the mixture was dispersed by a paint shaker for 15 hours to obtain a titanium oxide dispersion. An electrophotographic photosensitive member was produced and evaluated in the same way as in Example 30, except for using 140 parts of the titanium oxide dispersion in place of the tin oxide sol solution of the coating liquid for an intermediate layer in Example 30.

Example 34

An electrophotographic photosensitive member was produced and evaluated in the same way as in Example 33, except that 400 parts of the titanium oxide dispersion were used to prepare a coating liquid for an intermediate layer.

Example 35

An electrophotographic photosensitive member was produced and evaluated in the same way as in Example 33, except that 1200 parts of the titanium oxide dispersion were used to prepare a coating liquid for an intermediate layer and the thickness of the intermediate layer was set to 3 μm.

Comparative Example 1

An intermediate layer and an electrophotographic photosensitive member were produced and evaluated in the same way as in Example 1, except for preparing a coating liquid for an intermediate layer without using a polyolefin resin solution.

Comparative Example 2

An intermediate layer and an electrophotographic photosensitive member were produced and evaluated in the same way as in Example 1, except for preparing a coating liquid for an intermediate layer using (B-16) as the polyolefin resin without using an ethylene-acrylic acid binary copolymer solution.

Comparative Example 3

An intermediate layer and an electrophotographic photosensitive member were produced and evaluated in the same way as in Example 1, except for preparing a coating liquid for an intermediate layer using (B-17) as the polyolefin resin and using 50 parts of the ethylene-acrylic acid binary copolymer solution and 20 parts of the polyolefin resin solution.

Comparative Example 4

An intermediate layer and an electrophotographic photosensitive member were produced and evaluated in the same way as in Example 1, except for preparing a coating liquid for an intermediate layer using (B-18) as the polyolefin resin and using 50 parts of the ethylene-acrylic acid binary copolymer solution and 20 parts of the polyolefin resin solution.

Comparative Example 5

An intermediate layer and an electrophotographic photosensitive member were produced and evaluated in the same way as in Example 1, except for preparing a coating liquid for an intermediate layer using (B-19) as the polyolefin resin and using 50 parts of the ethylene-acrylic acid binary copolymer solution and 20 parts of the polyolefin resin solution.

Comparative Example 6

An intermediate layer and an electrophotographic photosensitive member were produced and evaluated in the same way as in Example 33, except for preparing a coating liquid for an intermediate layer using 100 parts of 10 mass % of a methanol solution of a polyamide resin (CM8000 (trade name) produced by Toray Industries Inc.) in place of the polyolefin resin solution and the ethylene-acrylic acid binary copolymer solution.

Table 2 shows the results.

| | Ratio of ethylen/acrylic acid binary coporlymer and poly-olefin resin in the intermediate layer | Poly-olefin | (A2)/{(A1) + (A2) + (A3)} × 100 | (A1)/(A3) | Ghost phenomenon evaluation | Evaluation of fluctuation by an environment | Evaluation of fluctuation by duration |
|---|---|---|---|---|---|---|---|
| Example 1 | 65/35 | B-1 | 20.00 | 7.00 | D | D | D |
| Example 2 | 60/40 | ↑ | ↑ | ↑ | C | C | C |
| Example 3 | 40/60 | ↑ | ↑ | ↑ | C | B | C |
| Example 4 | 30/70 | ↑ | ↑ | ↑ | C | B | C |
| Example 5 | 10/90 | ↑ | ↑ | ↑ | C | B | C |
| Example 6 | 5/95 | ↑ | ↑ | ↑ | C | C | C |
| Example 7 | 3/97 | ↑ | ↑ | ↑ | D | D | D |
| Example 8 | 60/40 | B-2 | 46.00 | 1.25 | D | D | C |
| Example 9 | 65/35 | B-3 | 1.00 | 98.00 | C | D | C |
| Example 10 | 30/70 | B-4 | 20.00 | 7.00 | C | B | C |
| Example 11 | 30/70 | B-5 | ↑ | ↑ | D | C | C |
| Example 12 | 30/70 | B-6 | ↑ | ↑ | D | C | C |
| Example 13 | 30/70 | B-7 | ↑ | ↑ | D | C | C |
| Example 14 | 30/70 | B-8 | 19.00 | 4.27 | C | C | C |
| Example 15 | 30/70 | B-9 | 22.00 | 2.90 | C | C | C |
| Example 16 | 60/40 | B-10 | 13.00 | 4.12 | C | B | B |
| Example 17 | 40/60 | ↑ | ↑ | ↑ | C | A | B |
| Example 18 | 30/70 | ↑ | ↑ | ↑ | C | A | B |
| Example 19 | 10/90 | ↑ | ↑ | ↑ | C | A | B |
| Example 20 | 5/95 | ↑ | ↑ | ↑ | C | B | B |
| Example 21 | 60/40 | B-11 | 10.00 | 8.00 | B | B | B |
| Example 22 | 40/60 | ↑ | ↑ | ↑ | B | A | B |
| Example 23 | 30/70 | ↑ | ↑ | ↑ | B | A | B |
| Example 24 | 10/90 | ↑ | ↑ | ↑ | B | A | B |
| Example 25 | 5/95 | ↑ | ↑ | ↑ | B | B | B |
| Example 26 | 30/70 | B-12 | 5.00 | 7.50 | B | A | A |
| Example 27 | ↑ | B-13 | 3.00 | 4.39 | B | A | A |
| Example 28 | ↑ | B-14 | 1.00 | 1.54 | B | A | A |
| Example 29 | ↑ | B-15 | 0.01 | 4.00 | B | A | A |
| Example 30 | 30/70 | B-13 | 3.00 | 4.39 | A | A | A |
| Example 31 | ↑ | ↑ | ↑ | ↑ | A | A | A |
| Example 32 | ↑ | ↑ | ↑ | ↑ | A | A | A |
| Example 33 | ↑ | ↑ | ↑ | ↑ | A | A | A |
| Example 34 | ↑ | ↑ | ↑ | ↑ | A | A | A |
| Example 35 | ↑ | ↑ | ↑ | ↑ | A | A | A |
| Comparative Example 1 | 100/0 | None | — | — | E | D | E |
| Comparative Example 2 | 0/100 | B-16 | 35.00 | 5.50 | E | D | D |
| Comparative Example 3 | 50/50 | B-17 | 0.00 | 1.50 | E | D | E |
| Comparative Example 4 | 50/50 | B-18 | 55.00 | 2.00 | E | E | D |
| Comparative Example 5 | 50/50 | B-19 | 34.00 | 1.20 | E | E | D |
| Comparative Example 6 | 30/70 | Polyamide resin | — | — | E | D | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-252120, filed Nov. 2, 2009 which is hereby incorporated by reference herein in its entirety.

What is claimed is:

1. An electrophotographic photosensitive member comprising:

a conductive support; and an intermediate layer, a charge generation layer and a charge transport layer which are provided on the conductive support in this order, wherein:

the intermediate layer contains an ethylene-acrylic acid binary copolymer and a polyolefin resin;

the polyolefin resin contains (A1), (A2) and (A3) as described below, and the mass ratio of the (A1), (A2) and (A3) satisfies a formula as described below:

$$0.01 \leqq [(A2)/\{(A1)+(A2)+(A3)\}] \times 100 \leqq 50$$

$$1.25 \leqq \{(A1)/(A3)\} \leqq 98,$$

(A1): a repeating structural unit represented by the following formula (11):

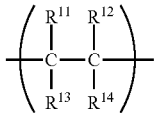

(11)

where $R^{11}$ to $R^{14}$ each independently represent a hydrogen atom or an alkyl group;

(A2): a repeating structural unit represented by one of the following formulae (21) and (22):

(21)

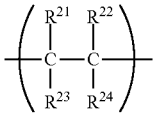

(22)

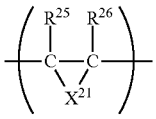

where $R^{21}$ to $R^{24}$ each independently represent a hydrogen atom, an alkyl group, a phenyl group, or a monovalent group represented by —$Y^{21}$COOH where $Y^{21}$ represents a single bond, an alkylene group or an arylene group; $R^{25}$ and $R^{26}$ each independently represent a hydrogen atom, an alkyl group or a phenyl group; and $X^{21}$ represents a divalent group represented by —$Y^{22}$COOCO$Y^{23}$— where $Y^{22}$ and $Y^{23}$ each independently represent a single bond, an alkylene group or an arylene group, provided that at least one of $R^{21}$ to $R^{24}$ represents a monovalent group represented by —$Y^{21}$COOH; and (A3): a repeating structural unit represented by one of the following formulae (31), (32), (33) and (34):

(31)

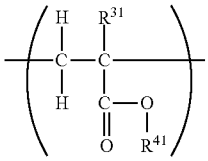

(32)

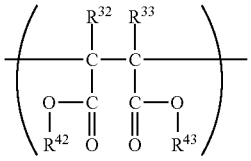

(33)

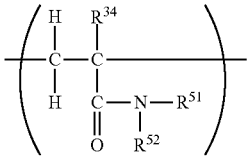

(34)

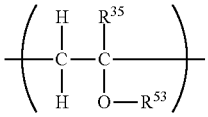

where $R^{31}$ to $R^{35}$ each independently represent a hydrogen atom or a methyl group;

$R^{41}$ to $R^{43}$ each independently represent an alkyl group having 1 to 10 carbon atoms, and $R^{51}$ to $R^{53}$ each independently represent a hydrogen atom or an alkyl group having 1 to 10 carbon atoms.

2. The electrophotographic photosensitive member according to claim 1, wherein the intermediate layer contains the ethylene-acrylic acid binary copolymer and the polyolefin resin at a mass ratio satisfying the following expression:

$$5/95 \leqq (\text{ethylene-acrylic acid binary copolymer})/(\text{polyolefin resin}) \leqq 60/40.$$

3. The electrophotographic photosensitive member according to claim 1, wherein a mass ratio of a repeating structural unit formed of acrylic acid in the ethylene-acrylic acid binary copolymer is larger than a mass ratio of the (A2) in the polyolefin resin contained in the intermediate layer.

4. The electrophotographic photosensitive member according to claim 1, wherein a mass ratio of the (A1), (A2) and (A3) satisfies the following formula:

$$0.01 \leqq (A2)/[\{(A1)+(A2)+(A3)\}]\times 100 \leqq 10.$$

5. The electrophotographic photosensitive member according to claim 1, wherein a mass ratio of the (A1), (A2) and (A3) satisfies the following expression:

$$0.01 \leqq [(A2)/\{(A1)+(A2)+(A3)\}]\times 100 \leqq 5.$$

6. The electrophotographic photosensitive member according to claim 1, wherein the intermediate layer further contains metal oxide particles.

7. The electrophotographic photosensitive member according to claim 1, wherein the polyolefin resin comprises at least one selected from the group consisting of an ethylene-maleic anhydride-acrylate ternary copolymer and an ethylene-maleic anhydride-methacrylate ternary copolymer.

8. The electrophotographic photosensitive member according to claim 6, wherein the metal oxide particles contain at least one kind of metal oxide particle selected from the group consisting of titanium oxide, zinc oxide and tin oxide.

9. A process cartridge, comprising:

the electrophotographic photosensitive member according to claim 1; and at least one unit selected from the group consisting of a charging unit, a developing unit, a transfer unit and a cleaning unit, wherein the process cartridge integrally supports the electrophotographic photosensitive member and the at least one unit, and is attachable to and detachable from a main body of an electrophoto graphic apparatus.

10. An electrophotographic apparatus, comprising:

the electrophotographic photosensitive member according to claim 1;

a charging unit;

an exposing unit;

a developing unit; and a transfer unit.

* * * * *